United States Patent [19]

Bohl, Jr. et al.

[11] Patent Number: 4,705,488

[45] Date of Patent: Nov. 10, 1987

[54] EYE ASSEMBLY FOR TOY DOLLS

[75] Inventors: Walter L. Bohl, Jr.; Michael E. Belfor, both of Cincinnati, Ohio

[73] Assignee: Kenner Parker Toys Inc., Beverly, Mass.

[21] Appl. No.: 776,722

[22] Filed: Sep. 16, 1985

[51] Int. Cl.[4] ..... A63H 3/38

[52] U.S. Cl. ..... 446/393

[58] Field of Search ..... 446/345, 389, 392, 393, 446/391, 372; 623/4; 24/17 AP, 30.5 P, 297

[56] References Cited

U.S. PATENT DOCUMENTS

| | | | |
|---|---|---|---|
| 1,221,589 | 4/1917 | Pudlin | 446/389 |
| 1,740,675 | 12/1929 | Wilhelm | 446/392 |
| 1,963,129 | 6/1934 | Grubman | 446/389 |
| 2,202,896 | 6/1940 | Buchner et al. | 446/392 |
| 2,425,510 | 8/1947 | Cohn | 446/345 |
| 2,670,569 | 3/1954 | Heina | 446/392 |
| 2,966,005 | 12/1960 | Anderson | 446/392 |
| 3,252,246 | 5/1966 | Brudney | 446/393 |
| 4,233,776 | 11/1980 | Suzuki | 446/392 |
| 4,409,754 | 10/1983 | Moreau | 446/392 |

FOREIGN PATENT DOCUMENTS

| | | | |
|---|---|---|---|
| 2261824 | 6/1974 | Fed. Rep. of Germany | 24/297 |
| 1165376 | 5/1958 | France | 446/392 |

*Primary Examiner*—Richard T. Stouffer

*Attorney, Agent, or Firm*—L. MeRoy Lillehaugen; Gene O. Enockaon; Stuart R. Peterson

[57] ABSTRACT

The eye assembly includes two eyeball units, a socket unit for each eyeball unit and a holder unit that grips the shanks of the two socket units. The eyeball unit in each instance includes a lens having a rib extending peripherally therearound and printed artwork on its somewhat curved rearwardly facing surface providing a pupil and iris, the iris having outwardly diverging lines thereon. The lens has a curved forwardly facing surface so that a simulated eye movement is provided as a result of the refraction and magnification that occur where there is relative movement between the child and doll having the eye assembly incorporated therein. Each of the socket units includes a rearwardly projecting shank and the holder unit includes a plurality of resilient fingers that engage one of several annular ribs formed on the shank of each socket unit. The eye unit and socket unit are preassembled so that when the holder unit is placed against the inner surface of the doll's head during assembly, then all that the assembler need do is to push the shanks through holes provided in the material constituting the doll's skin, the shanks then being held by the resilient fingers of the holder unit.

6 Claims, 24 Drawing Figures

FIG. 23
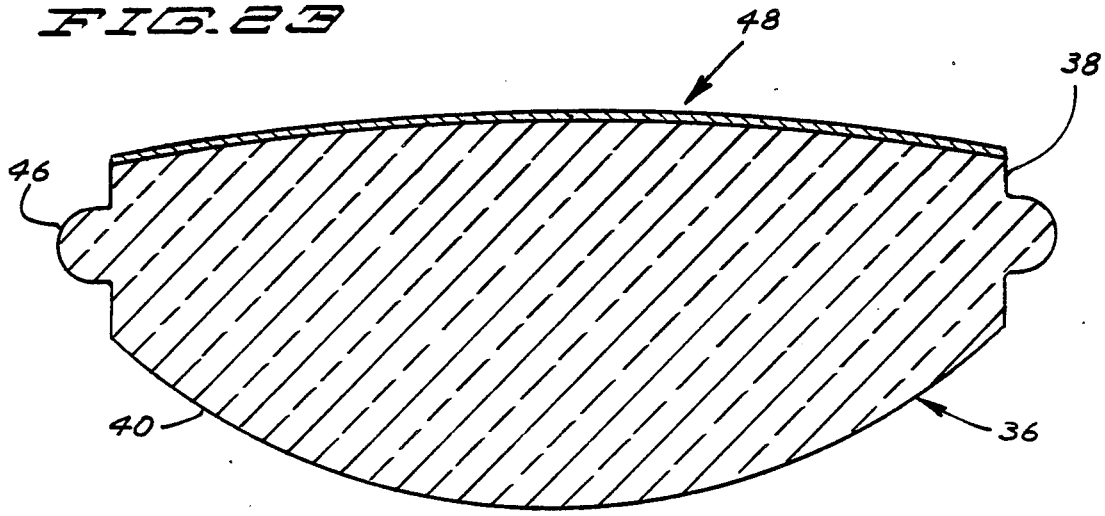
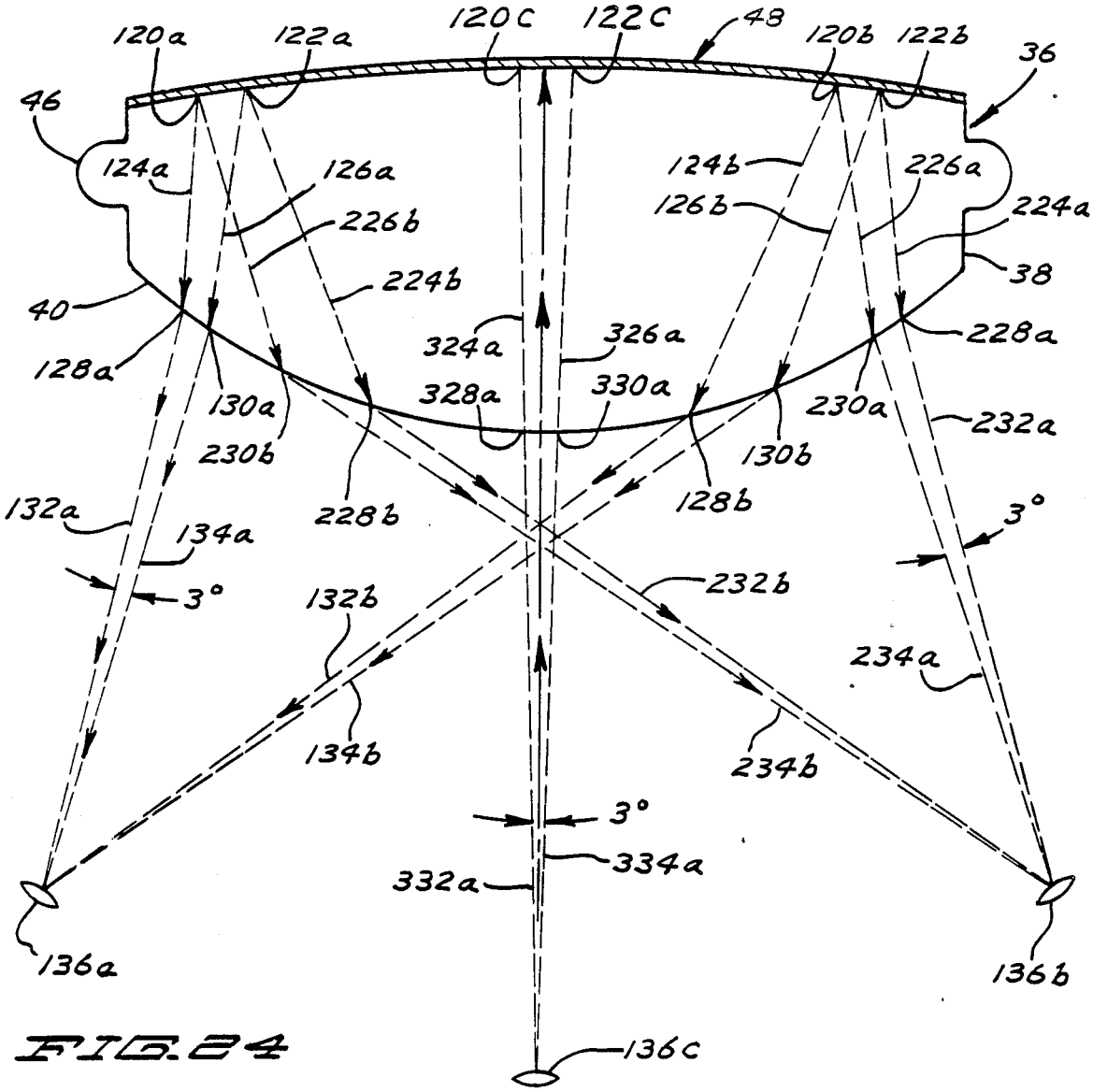
FIG. 24

EYE ASSEMBLY FOR TOY DOLLS

BACKGROUND OF THE INVENTION

1. Field of the Invention

This invention relates generally to toy dolls, and pertains more particularly to an eye assembly especially suited for stuffed dolls.

2. Description of the Prior Art

Toy dolls are produced in various forms, some being quite inexpensive and some being relatively costly. Insofar as stuffed dolls are concerned, the eye structures for this type of doll are usually simpler than in hard-skinned dolls where frequently eye mechanisms are employed with eye lids that open and close. In stuffed dolls, only a painted eye is at times utilized. At other times, a glass or plastic eye is employed but secured in a very elementary fashion, usually such that it may be pulled off by the child and lost, or, even worse, swallowed by the youngster. Generally, eyes used in the manufacture of stuffed dolls do not have the degree of realism that a doll should ideally possess. This can be attributed to cost factors, both as to materials and the time required to mount the eye at the factory. Consequently, prior art dolls, especially of the stuffed variety, have lacked the overall appeal that one would like to have insofar as a toy doll is concerned.

SUMMARY OF THE INVENTION

Accordingly, one object of the present invention is to provide an eye assembly for toy dolls in which the eye has an extremely realistic appearance. Not only is the eye quite realistic so as to impart a personality to the doll, but the degree of realism is enhanced by reason of the eye producing a simulated eye movement as the doll is moved relative to the child or when the child moves relative to the doll.

Another object of the invention is to provide an inexpensive eye assembly for dolls, thereby encouraging its widespread adoption, particularly where stuffed dolls are concerned. In this regard, not only does the invention contemplate the use of low-cost materials, but permits an eye assembly to be installed in a stuffed doll with a minimum amount of labor. It is an aim of the invention to preassemble certain parts and later, when the doll is being fabricated, to complete the assembly, doing so quickly and easily.

Yet another object of the invention, which is a very important object, is to provide an eye assembly that will be almost 100 per cent safe insofar as small children are concerned. It is within the purview of the invention to mount the eye assembly in such a fashion that the eyeball unit is recessed in a socket such that a child of virtually any age cannot pick out or otherwise remove the eyeball unit. Where extremely young children are playing with a doll, it is vitally important that the eyeball unit fixedly be retained in the doll's head, for once removed it can be lost or swallowed by the child.

Another object is to provide a toy doll, such as a stuffed doll, in which the eye assembly is virtually indestructible. In this regard, it is an aim of the invention to permit the doll to be dropped or mishandled to a considerable degree and still not have the eyeball unit become detached or the parts constituting the eye assembly broken.

Still further, the invention has for another object the provision of an eye assembly for stuffed dolls in which the eye assembly will not be damaged when the doll is washed, even though the doll is completely submerged during the bathing process.

Briefly, our invention envisages an eyeball unit that includes artwork on the back side thereof that provides a pupil and a specially patterned iris that in conjunction with the refractive capabilities of the lens provides a simulated eye movement. The lens of the eyeball unit has a rib extending therearound so that the eyeball unit will be firmly held within a socket unit possessing a groove in which the rib is received. The lens of the eyeball unit has two triangular extensions that fit in complementary portions of the socket unit to prevent unwanted rotation of the eyeball unit. When the eyeball unit is being mounted in the socket unit, eyelash units are initially held in proper position on the lens of the eyeball unit by reason of pressure-sensitive adhesive strips. However, a more permanent retention of each eyelash unit is effected by reason of the rib and groove arrangement that holds the eyeball unit within the socket unit.

The eyeball units, eyelash units and socket units after being initially assembled together are mounted in the doll's head by being inserted into a holder unit placed against the inside surface of the head, the holder unit being apertured and provided with resilient fingers so that both of the socket units and both of the eyeball units are securely held in place. This is done by simply pressing the shanks of each socket unit through the laterally spaced apertures in the holder unit. By means of annular ribs on the shanks, the resilient fingers engage the ribs so that neither of the two shanks can be pulled or detached from the holder unit once the assembly has been completed.

BRIEF DESCRIPTION OF THE DRAWINGS

FIG. 23 is an even larger sectional view, the view being taken in the direction of line 23—23 of FIG. 20, and FIG. 24 is a diagrammatic view corresponding to FIG. 23, but with certain light ray paths having been superimposed thereon corresponding to the viewing angles of FIGS. 21 and 22.

DESCRIPTION OF THE PREFERRED EMBODIMENT

Figure 1:
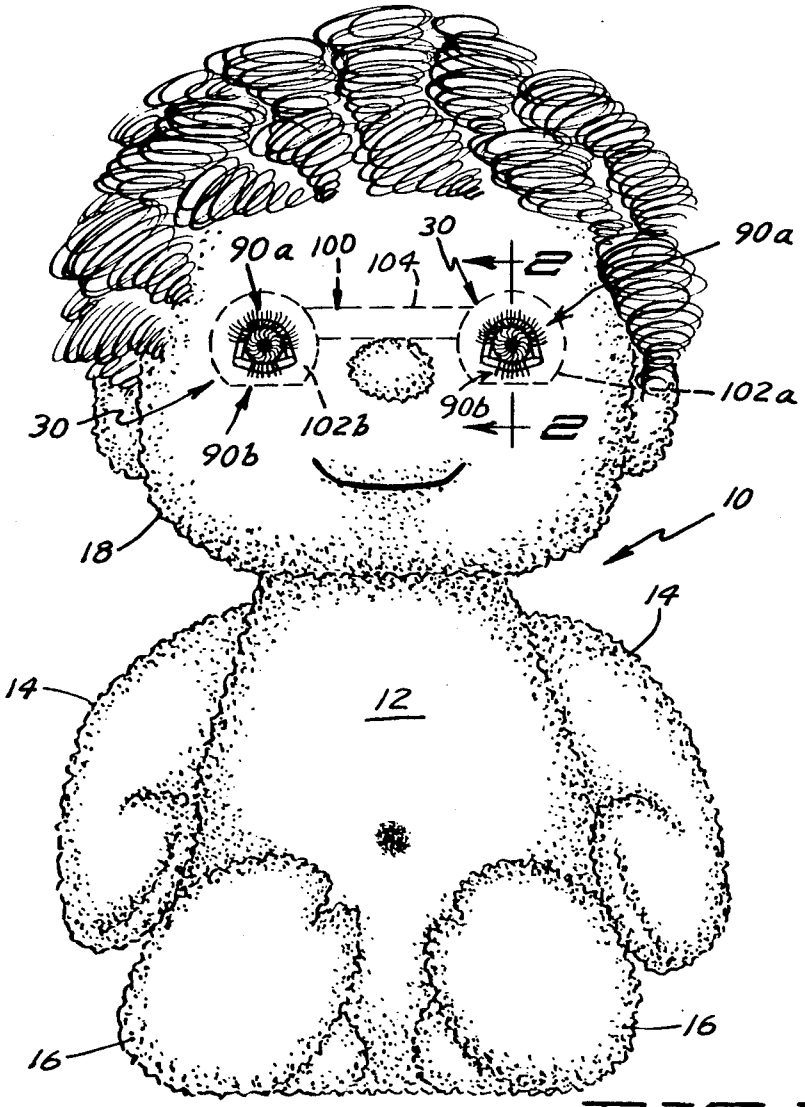
FIG. 1 is a front elevational view of a toy doll with our eye assembly mounted therein.
Figure 3:
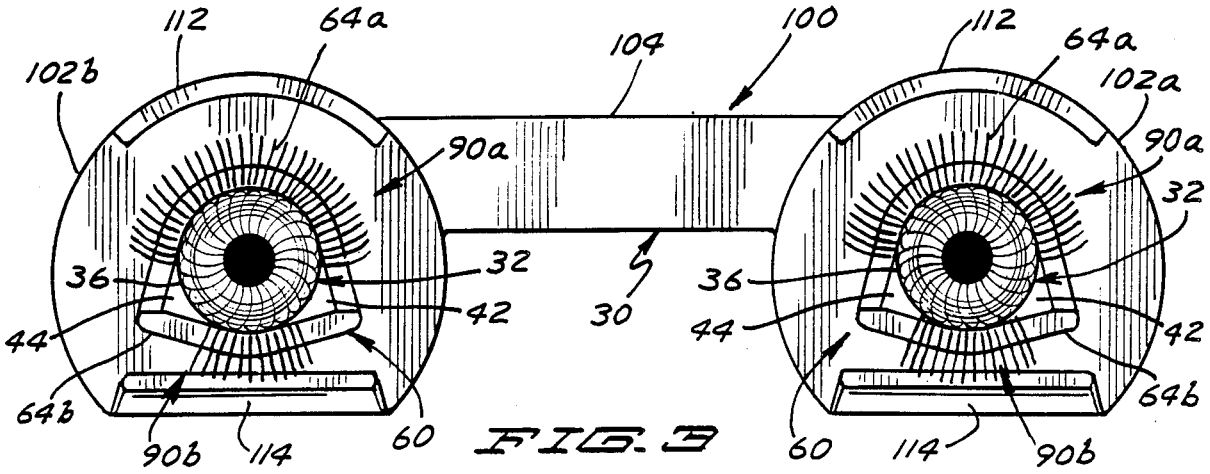
FIG. 3 is a front elevational view of the eye assembly divorced from the doll.
Figure 4:
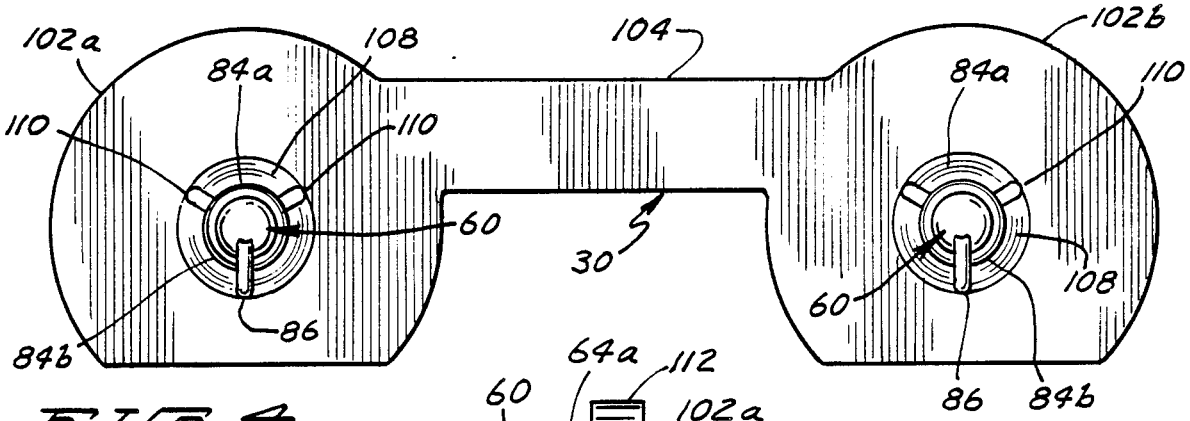
FIG. 4 is a rear elevational view of the eye assembly.
Figure 5:
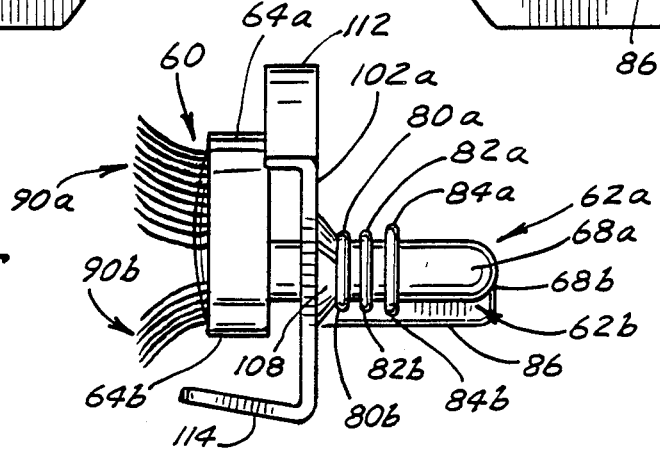
FIG. 5 is a side elevational view of the eye assembly, the view being taken from the right in FIG. 3.

Referring first to FIG. 1, it will be observed that a stuffed doll 10 exemplifying my invention has been pictured. The doll 10 comprises a body 12, arms 14, legs 16 and a head 18. It is readily apparent that the doll 10 possesses a human-like appearance, but it should be emphasized that the doll 10 can assume various animal forms as well, for our eye assembly can be incorporated into dolls of various forms.

Inasmuch as it has been assumed that the doll 10 is a stuffed doll, it is comprised of a relatively heavy fabric 20 that has an outer plush or pile-like surface indicated by the reference numeral 22. The fabric 20 appears in FIG. 2, as well as some of the material constituting the stuffing or padding for the head, the stuffing having been labeled 24. It will be appreciated, though, that the fabric 20 is comprised of various individual segments that are stitched together in order to encase the material 24 therein.

An eye assembly in accordance with our invention has been denoted in its entirety by the reference numeral 30. The assembly 30 includes an eyeball unit 32 comprising a lens 36 having a rear disc portion 38 and a forward spherical portion 40, the two portions 38 and 40 being integral with each other. The lens 36 is generally cylindrical, having a diameter on the order of 0.510 inch, but is formed with triangular projections 42 and 44 which serve a purpose later to be mentioned. At this time, however, it can be explained that the lens 36 is of a clear or transparent plastic, such as acrylic.

The lens 36 has a peripheral rib 46 that extends around the circular portion of the disc portion 38 and also around the triangular projections 42 and 44. The rib 46 has a height or peripheral thickness on the order of 0.030 inch all around. The rib 46 plays a relatively important role in the practicing of our invention, and more will be said presently concerning the purpose of the rib 46.

It has been stated that the lens 36 has a spherical portion 40. For the diameter of 0.510 inch mentioned above, the spherical portion 40 of the lens 36 has a spherical radius of 0.375 inch.

The eyeball unit 32 additionally includes a decal layer 48 containing artwork or a printed pattern that provides a pupil 50 and an iris 52. The iris 52 is generally quite light in color but has a plurality of printed curved dark lines 54 radiating outwardly from the pupil 50. Thus, the iris 52 includes a lighter background 56, the lines 54 being printed on the lighter background 56 and readily discernible by reason of the optical contrast with the background 56. What should be understood is that the back side of the lens 36 is not flat, having a spherical radius on the order of 1.50 inches, a value selected in accordance with the previously mentioned 0.510 inch diameter of the lens 36; the curved rear, even though slight, of the lens 36 has been given the reference numeral 58 in FIGS. 23 and 24. The decal 48, which in the form of a label or sticker, and hence flexible, readily conforms to the convex shape of the surface 58. The curved shape of the rear surface 58 eliminates the so-called flat mirror reflection effect. The shape of the spherical surface 58 also adds to the depth of the eyeball unit 32 and additionally facilitates artwork application when pad printing technology is used, especially in that the trapping of air bubbles is prevented. Due to the magnification derived from the curved surface 40 of the lens 36, the magnification being greatest at the center and decreasing radially outwardly, the pupil 50 appears larger than it actually is; therefore, when preparing the artwork, the pupil 50 is deliberately made smaller, so that when the eyeball unit 32 is actually viewed, the size of the pupil 50 is seen to be dimensionally correct in relation to the surrounding iris 52. Thus, a very realistic effect is achieved by reason of the construction of the entire eyeball unit 32 as just described.

Figure 9:
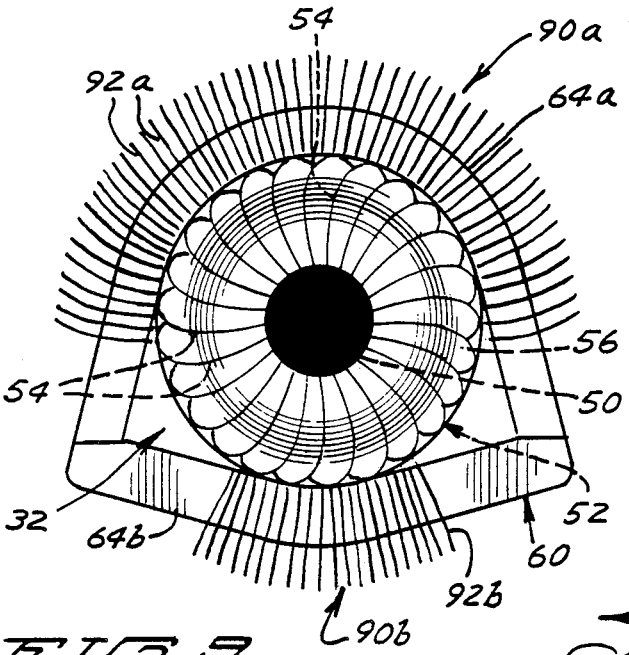
FIG. 9 is a front elevational view of one eyeball unit, upper and lower eyelash units and one socket unit in readiness to be assembled with the holder unit.
Figure 10:
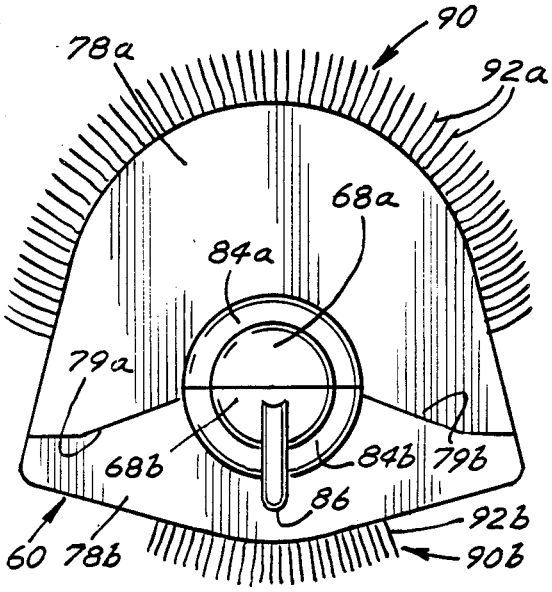
FIG. 10 is a rear view corresponding to FIG. 9.
Figure 11:
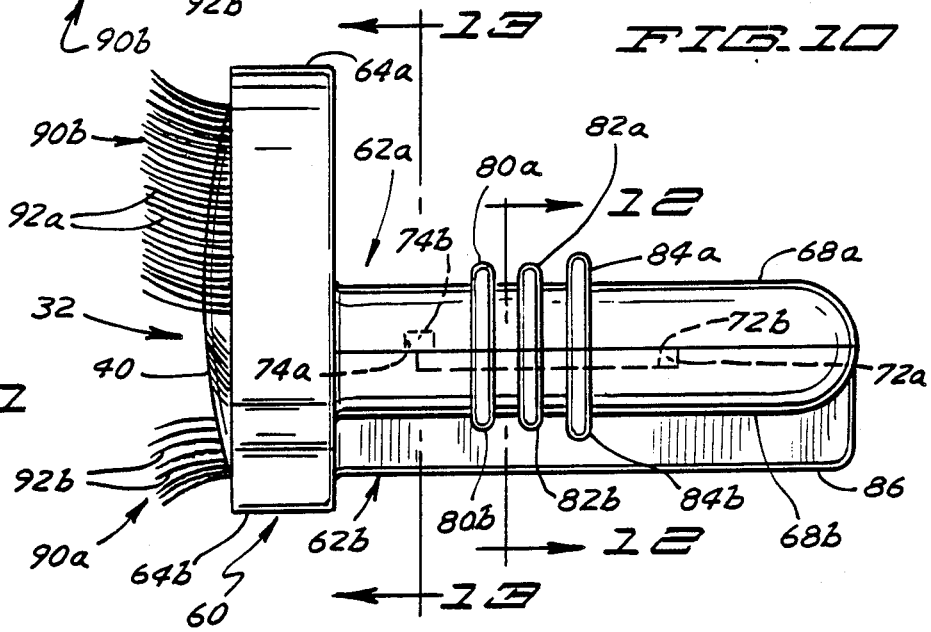
FIG. 11 is a side elevational view corresponding to FIG. 9, the view being taken from the right.
Figure 12:
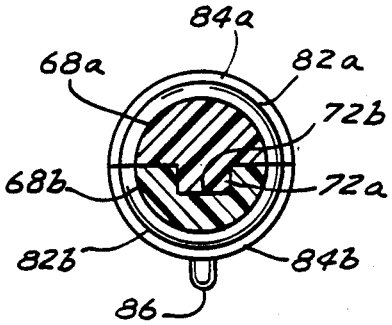
FIG. 12 is a sectional detail taken in the direction of line 12—12 of FIG. 11.
Figure 13:
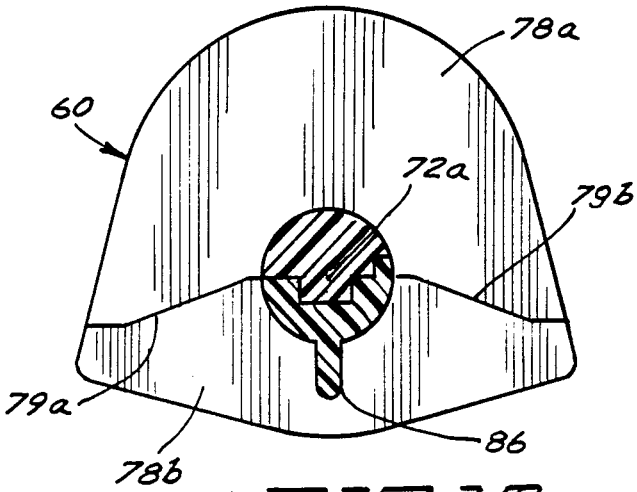
FIG. 13 is a sectional detail taken in the direction of line 13—13 of FIG. 11.
Figure 14:
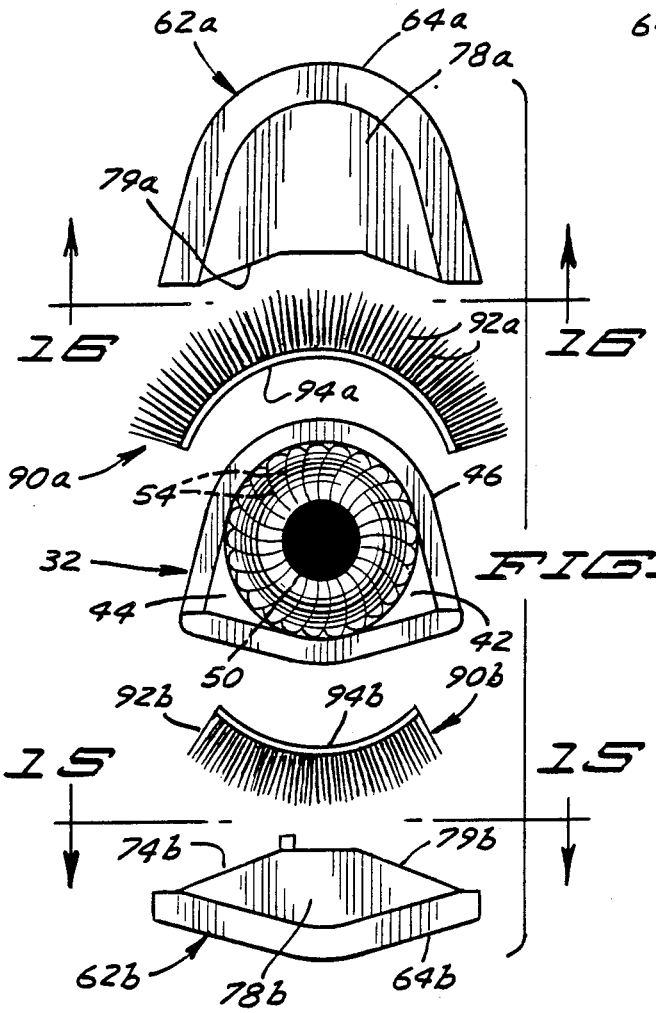
FIG. 14 is an exploded view of FIG. 9.

At this time, attention is directed to a socket unit 60, such as ABS plastic, comprised of an upper stem 62*a* and a lower stem 62*b*. The upper stem 62*a* includes a forwardly facing flange 64*a* having an inverted U-shaped appearance, whereas the lower stem 62*b* has a forwardly directed flange 64*b* possessing a wide V-shaped appearance. The flanges 64*a* and 64*b*, as can be seen in FIG. 9, abut each other at angles corresponding to the previously mentioned triangular projections 42 and 44, thereby preventing rotation of the eyeball unit within the socket unit 60.

It is important to appreciate that the flange 64*a* has a groove 66*a* formed therein, whereas the flange 64*b* has a groove 66*b* formed therein. When the stems 62*a* and 62*b* are mated together, as will be explained more fully hereinafter, the grooves 66*a* and 66*b*, being in a relatively rigid plastic (ABS), form a continuous groove that receives therein the entire peripheral rib 46 formed on the disc portion 38. This is the way in which the eyeball unit 32 is firmly retained in the socket unit 60.

Figure 16:
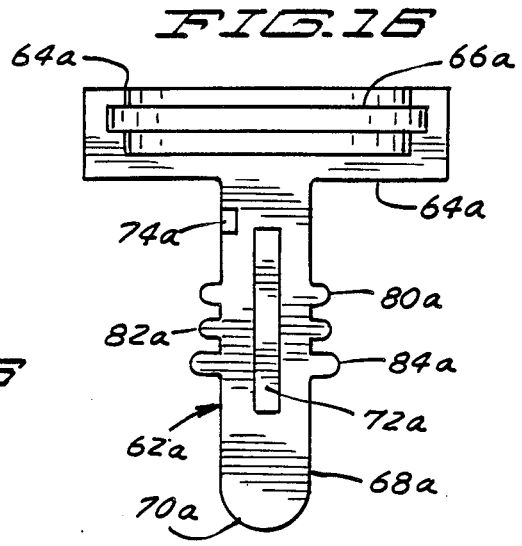
FIG. 16 is a view taken in the direction of line 16—16 for the purpose of showing the lower surface of the other stem member, the two stem members when mated together constituting a socket unit.
Figure 15:
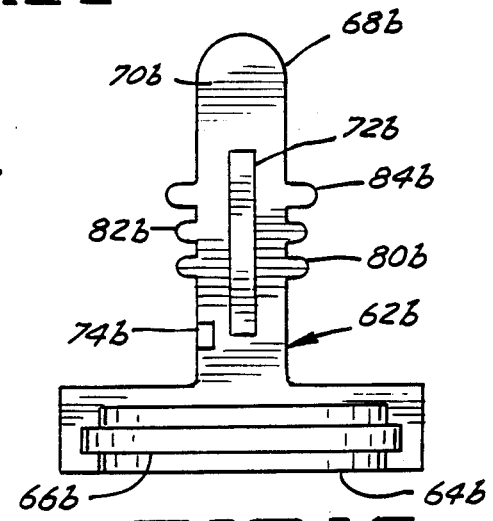
FIG. 15 is a view in the direction of line 15—15 of FIG. 14, the view showing the upper surface of one of the stem members.
Figure 17:
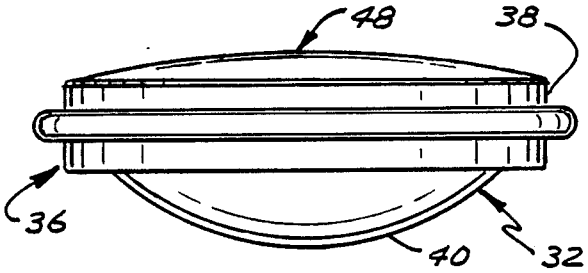
FIG. 17 is a top plan view looking down on an eyeball unit.
Figure 18:
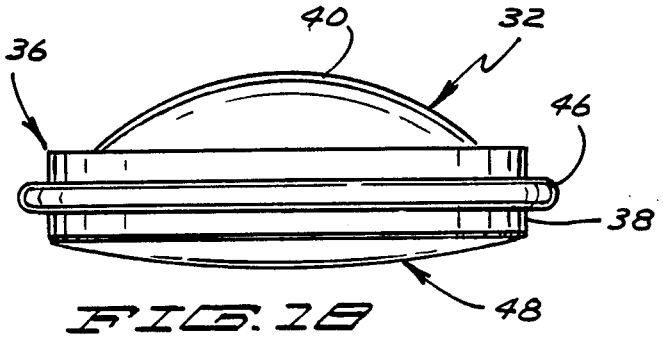
FIG. 18 is a bottom view looking up at the bottom of the eyeball unit.
Figure 19:
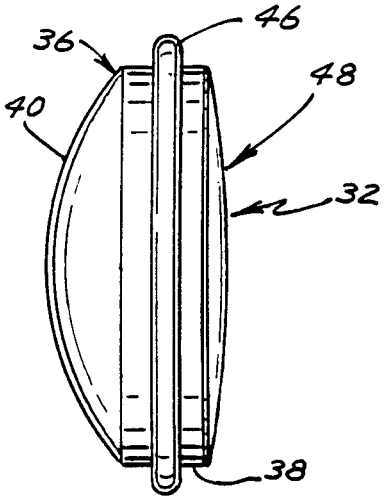
FIG. 19 is a side view of the eyeball unit.

Continuing now with the description of the socket unit 60, this unit additionally comprises a rearwardly directed shank comprised of shank portions 68*a* and 68*b*; the shank portion 68*a* is integral with the upper stem 62*a*, whereas the shank portion 68*b* is integral with the lower stem 62*b*. The shank portion 68*a* has a flat surface at 70*a*, and the shank portion 68*b* has a flat surface 70*b*. These surfaces can best be viewed in FIGS. 15 and 16. Also, as can be seen from FIG. 16, the flat surface 70*a* has a longitudinal rib 72*a* formed thereon. The flat surface 70*b* has a longitudinal groove 72*b* formed therein. Additionally, the flat surface 70*a* has a rectangular notch 74*a* formed therein, as can be understood from FIG. 16, whereas the surface 70*b* has a tab 74*b* of a size to fit within the notch 74*a*. In this way, when the two stems 62*a* and 62*b* are mated together, then the interfitting rib 72*a* with the slot 72*b* plus the interfitting of the tab 74*b* with the notch 74*a* assures a precise mating of the two stems 62a, 62b. Sonic welding is employed for securely holding the two stems 62a and 62b together.

It should also be noted that the stem 62a has a small panel or web 78a which has the previously mentioned flange 64a extending around its periphery, whereas the stem 62b is formed with a smaller panel 78b. The two panels 78a and 78b have complemental edges 79a, 79b, respectively. Consequently, when the two stems 62a, 62b are assembled and sonically held together to form the socket unit 60, one sees the forming of a composite panel comprised of the panels 78a and 78b which serve as a backing for the decal 48. Stated somewhat differently, the two panels 78a, 78b have a shape corresponding generally to the profile or outline of the eyeball unit 62.

It should be distinctly observed that the socket unit 60, when the stems 62a and 62b are secured together by sonic welding (although an appropriate adhesive could be used), secures the eyeball unit 32 in place, for the rib 46 is then received in the groove composed of the groove portions 66a and 66b of the socket unit 60.

Still further, it is to be recognized that the socket unit 60 has what amounts to annular retention ribs formed on the shank composed of the shank portions 68a and 68b. Actually, since the socket unit 60 is comprised of the two stems 62a and 62b, the annular retention ribs are actually in the form of semicircular ribs before the stems 62a and 62b are mated with each other. More specifically, the upper stem 62a has semicircular ribs 80a, 82a and 84a formed thereon, the rib 84a having a larger radius than the ribs 80a and 82a. Formed on the lower shank portion 68b are semicircular ribs 80b, 82b and 84b, the rib 84b having the same radius as its counterpart 84a. Still further, the lower shank portion 68b of the socket unit 60 has a longitudinal guide rib or key 86 formed thereon that aids in the mounting of the eye assembly in the doll's head 18, as soon will become manifest.

Reference will now be made to an upper eyelash unit denoted by the reference numeral 90a and a lower eyelash unit denoted by the reference numeral 90b. The unit 90a has a series of projecting eyelashes 92a, whereas the other unit 90b has a plurality of eyelashes 92b projecting therefrom. The upper eyelash unit 90a has a pressure-sensitive adhesive strip 94a associated therewith so that it can be sealed to the upper edge of the eyeball unit 32, more specifically conformed to and retained in place on the peripheral rib 46. Similarly, the lower eyelash unit 90b includes a pressure-sensitive adhesive strip 94b that can be likewise sealed to the rib 46, that is, the portion of the rib 46 residing at the bottom of the eyeball united 32.

It will perhaps be helpful at this point to explain that when assembling the eyeball unit 32 in the socket unit 60, the retention of the eyelash units 90a and 90b on the rib 46 makes it such that when the two stems 62a, 62b are brought together and sonically welded, then the bringing together and welding of the flanges 64a and 64b will literally wedge the strips 94a and 94b into portions of the grooves 66a and 66b. In this way, the eyelash units 90a and 90b are firmly retained in place by the same arrangement that retains the eyeball unit 32 in place within the socket unit 60.

The foregoing is all done on a preassembly basis so that the eyeball unit 32, the socket unit 60 and the eyelash units 90a and 90b are all held together so that the remaining assembly procedure is vastly simplified, all in a manner now to be described.

Referring now to a holder unit indicated generally by the reference numeral 100, it will be perceived that the holder unit 100 includes a pair of laterally spaced annular discs or washers 102a and 102b, having a flexible bridging strip 104 extending therebetween. Each of the annular discs or washers 102a, 102b has an aperture 106 formed therein for the acceptance of the shank composed of the shank portions 68a and 68b.

Figure 6:
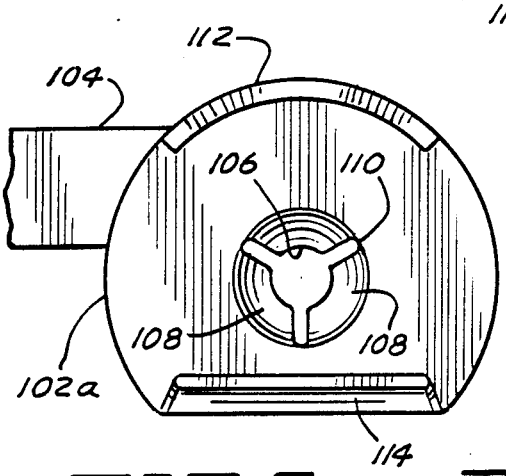
FIG. 6 is a front elevational view of the right portion of the holder unit.
Figure 8:
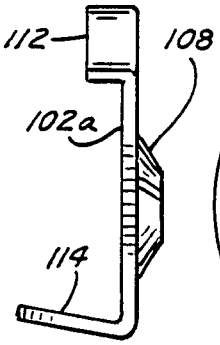
FIG. 8 is a right-hand view corresponding to FIG. 6.
Figure 7:
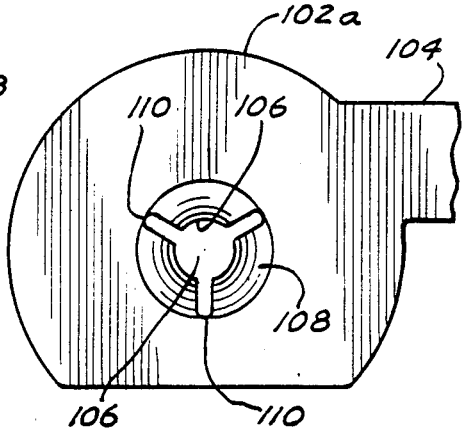
FIG. 7 is a rear view corresponding to FIG. 6.

It is contemplated that the holder unit 100 be of resilient and pliable plastic, such as polypropylene. Therefore, it can be understood that three rearwardly sloping resilient fingers 108, there being a trio of such fingers for each of the annular discs 102a, 102b have slots 110 therebetween. As can be fully comprehended from FIGS. 6 and 7, the slots 110 are spaced at 120° angles with respect to each other. The importance of the resilient fingers 108 will soon become manifest.

At this time, it should be observed that there is a forwardly projecting curved flange 112 rimming an upper portion of each disc 102a, 102b and a lower straight flange 114 projecting from the bottom of each disc 102a, 102b. From FIG. 2, it will be seen that these flanges 112 and 114 help in forming the shape of the head in the vicinity of the two eyeball units 32. It will be recalled that the head 18 is comprised of a heavy fabric 20 that is somewhat flexible. Thus, the flanges 112 and 114 are instrumental in performing a formative function.

Figure 2:
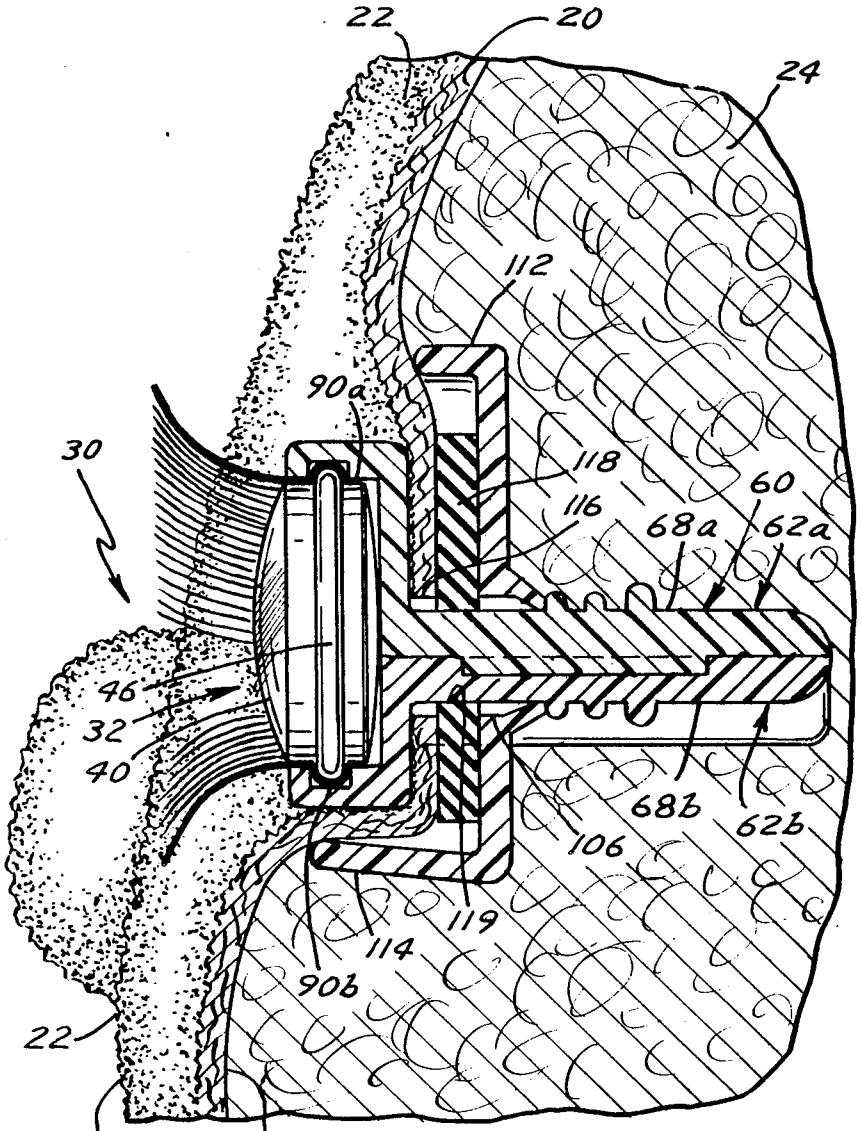
FIG. 2 is a greatly enlarged sectional view taken in the direction of line 2—2 of FIG. 1.

From FIG. 2, it can be seen that the portion of the fabric 20 there appearing has an aperture or hole 116. Reinforcing the hole 116 is a hole reinforcement member 118 and there is one such reinforcing member 118 for each eyeball unit 32 held in the socket unit 60. The reinforcing members 118, actually washers, can be of any suitable material, such as an elastomeric material or a fibrous material with threads or filaments therein. Each reinforcing member 118 has a hole 119 therein, and is readily held in place by means of an adhesive backing.

Although the manner of assembling the various parts has been generally referred to, a brief assembling procedure now to be given should be of benefit in appreciating the advantages to be derived from a practicing of our invention. Therefore, the decal 48 having the artwork constituting the pupil 50 and iris 52 thereon is first adhered to the back side of the eyeball unit 32, more specifically, to the rear of the lens 36. The lens 36 and the decal 48 constitute the eyeball unit 32, the transparent lens 36 enabling the child to view the artwork on the decal 48.

Next, the eyelash units 90a and 90b are applied to segmental portions of the rib 46 by means of the pressure-sensitive adhesive strips 94a and 94b.

It is then that the eyeball unit 32, together with the now applied eyelash units 90a, 90b are in readiness for being assembled in the socket unit 60. Of course, it must be borne in mind that the socket unit 60 is initially of two parts, namely, the upper stem 62a and lower stem 62b. The shank portions 68a and 68b are easily aligned with each other by virtue of the rib 72a in groove 72b and the tab 74b in notch 74a arrangement. The groove and tab/notch relation assures a proper keying together of the two stems 62a and 62b. Concomittantly with the registering of the surfaces 70a and 70b, the flange portions 64a and 64b are brought into juxtaposition with each other, at this time accepting the rib 46 in the grooves 66a and 66b. It should be recognized, though, that at this time the eyelash units 90*a* and 90*b* are also being permanently retained, having been first bonded in place, however.

Once the two stems 62*a* and 62*b* are secured together, then the socket unit 60 becomes an integral unit. From FIG. 2, it can be seen that the eyeball unit 32 is for all intents and purposes recessed within the flange portions 64*a* and 64*b* of the socket unit 60, thereby making it extremely difficult, if not impossible, for any child to grip the lens of the eyeball unit 32 with her fingers because there is nothing protruding to the extent that a firm grip can be achieved. From a safety standpoint, this is quite an exceedingly important feature.

Next, the person assembling the doll 10 applies the hole reinforcement members 118, although one such member, in the form of a stripe, could extend from one eye location to the other. After this, the assembler positions the holder unit 100 in place, doing so to the extent that the apertures 106 are in general alignment with the holes 116 in the fabric 20. Of course, this is done before any of the stuffing material 24 is placed in the head 18. At this time, the fabric 20 can even be rolled forwardly so that the back side thereof adjacent the eye locations are fully accessible.

Having oriented the socket unit 60, then all that the assembler need do is to take each of the eyeball units 32, together with their respective socket units 60, pressing the eyeball units 32 rearwardly so that the shank portions 68*a* and 68*b* pass through the apertures 106 in the annular discs 102. Sufficient rearward movement will cause the shank portions 68*a* and 68*b*, now forming a shank because of the adherence of the surfaces 60*a* and 60*b* together by sonic welding, to readily flex the resilient fingers 108 so that the rearward movement of the shank composed of the portions 68*a*, 68*b* can easily occur. Once the back side of the small panels or webs 78*a* and 78*b* engage the fabric 20 and then force the hole reinforcement member 118 against the particular annular disc 102*a*, 102*b*, then, depending upon the degree of rearward movement or insertion, the ribs 80*a*, 80*b* in this instance resist retraction of the socket unit 60. It is obvious that the ribs 82*a*, 82*b* would serve the same purpose. The larger ribs 84*a*, 84*b* function as a safeguard to retain the socket unit 60, and hence the eyeball unit 32, in place, should for any reason, the ribs 80*a*, 80*b*, 82*a* and 82*b* be pulled back through the aperture 106. Stated somewhat differently, the larger ribs 84*a*, 86*a* provide an important redundant feature as far as safety is concerned. Thus, the use of several longitudinally spaced annular ribs enable the manufacturing tolerances to be relaxed considerably, for one does not have to have the parts fabricated with any great degree of precision. It might be pointed out that as the shank, composed of the portions 68*a* and 68*b*, is being inserted, the shank portions 68*a*, 68*b* are guided by the longitudinal guide rib 86. In other words, the guide rib 86 enters the lowermost slot 110, more specifically, the one at the 6 o'clock position.

Having installed one eyeball unit 32 in one side of the socket unit 60, as just described, it should be evident that the same procedure is resorted to in mounting the other eyeball unit 32 in the other half of the socket unit 60. In other words, there is but one holder unit 100, but because of the two annular discs or washers 102*a*, 102*b* integral therewith, both eyeball units 32 are readily accomodated and held in a properly spaced relationship with each other, because the two annular discs 102*a*, 102*b* are correctly spaced by virtue of the flexible bridging strip 104.

Figure 20:
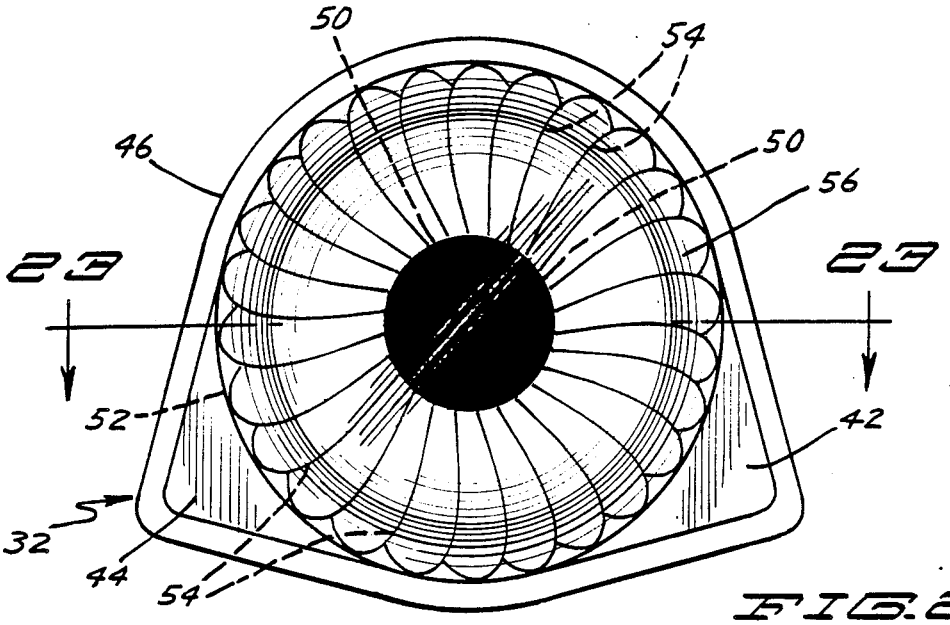
FIG. 20 is a front elevational view of one eyeball unit and the socket unit in which it is retained, the view resembling FIG. 9 but omitting the two eyelash units.
Figure 21:
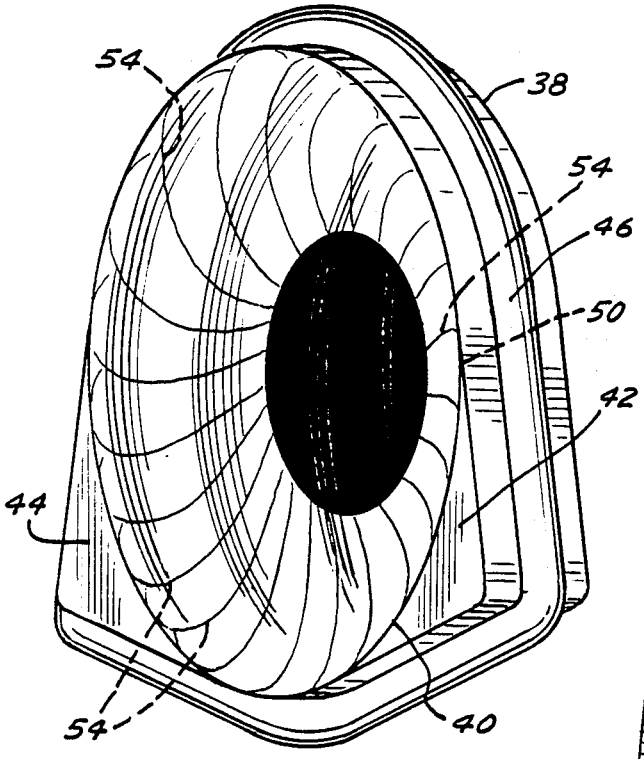
FIG. 21 is an angled view of the eyeball unit of FIG. 20, the view being taken at approximately 45° from the right.

Although quite difficult to picture in a two dimensional drawing, it is important to at least know that a simulated eye movement is derived from the two eye assemblies 30. In an effort to portray what happens, reference should be made to FIGS. 20–24. FIG. 20 depicts what a person will see when looking directly at a single eyeball unit 32, for the refraction is uniform. The refraction, of course, is derived from the lens 36. However, if the viewer of the doll 10 looks at the eyeball unit 32 from an angle of 45° when that person is to the right, then the image appearing in FIG. 21 is seen. The refraction, owing to the fact that the light passes through a greater amount of the plastic lens 36 at the left than at the right, causes the lines 54 to appear to be farther apart at the left than at the right. By the same token, if the viewer is looking at the eyeball unit 32 from an angle of 45° from the left, then that person sees what is portrayed in FIG. 22. Succinctly stated, the light rays reflected from the iris 52 traverse more of the lens 36 at one side of the lens than the other when viewing the eyeball unit 32 at an angle than when viewing the eyeball unit 32 straight on, as is the case when looking at the eyeball unit 32 as shown in FIG. 20. The thickness of the lens 36 contributes to this unique appearance, for the disc portion 38 is of a uniform thickness, whereas the spherical segment 40 varies in thickness. It is due to the combined thickness of the disc 38 and whatever portion of the spherical segment 40 is between the viewer and the iris 52 that produces the expanded separation of the lines 54, as can be perceived from the left side of FIG. 21 and the right side of FIG. 22.

Figure 22:
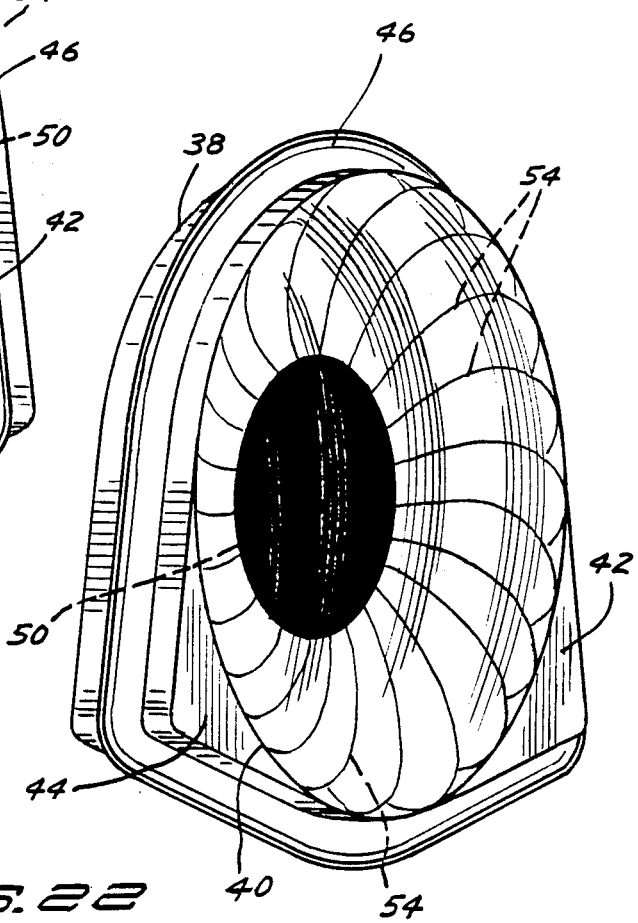
FIG. 22 is an angled view similar to FIG. 21 but being taken at an angle of approximately 45° from the left.

The above description has dealt with three static relationships, one when viewing the eyeball 34 straight on as in FIG. 20 and two with the angled viewing of the eyeball unit 32 as set forth in FIGS. 21 and 22, respectively. What cannot be fully appreciated from the description that has just been given is that whether the doll's head 18 is turned from one static relation to the other or whether the child moves relative to the doll's head 18, stopping, say, at each static relation. The result is that the eyes of the eyeball units 32 appear to be moving and following the moving person, or if the person is remaining stationary and the doll's head 18 is being twisted, the appearance is given that the doll 10 is still looking at the child even though the child is turning the doll's head 18. In either situation, the doll's eyes which are provided by the eyeball units 32 appear to be looking at the child during either relative movement situation.

In an effort to demonstrate what takes places, attention is now directed to FIG. 24. This FIG. 24 has various light ray paths superimposed thereon. While the ensuing description is not wholly satisfactory, nonetheless, it is believed to at least offer some assistance in understanding what takes place insofar as a simulated eye movement is concerned. It must be kept in mind, though, that the differences in thickness, and the resulting differences in refraction, at various locations on the lens 36 are instrumental in creating the simulated movement that has just been alluded to.

In an effort to illustrate what occurs, points 120*a* and 122*a* have been placed on the iris 52. These points appear toward the left in FIG. 24. Similar points 120*b* and 122*b* have been placed on the iris 52 at the right. Likewise, additional points 120*c* and 122*c* have been placed at the center of the iris 52. The points 120*a* and 122*a*, 120*b* and 122*b* and 120*c* and 122*c* are equidistant apart insofar as each pair is concerned.

Assuming now that a light ray 124*a* is reflected from the point 120*a* and strikes the outer or forward surface of the lens 36 at point 128*a*, then the refraction as the light passes into a less dense medium (air) as contrasted with the denser medium (the plastic constituting the lens 36), it traverses a path labeled 132*a*. Similarly, a ray 126*a* emanating from the point 122*a* strikes the surface of the lens 36 at point 130*a* and the emergent ray 134*a* forms an acute angle of approximately 3° with the ray 132*a*, striking a human eye 136*a*.

Going now to the other side of the lens 36 shown in FIG. 24, the two points 120*b* and 122*b* will be considered. The point 120*b* produces a reflected ray 124*b* that strikes the outer surface of the lens 36 at the point 128*b* and is literally bent more than the rays 132*a* and 134*a* because of the longer path that the ray 124*b* takes in passing through the lens 36. The emergent ray 132*b* strikes the eye 136*a*.

Insofar as the point 122*b* is concerned, a reflected ray 126*b* strikes the surface of the spherical segment 40 of the lens 36 at point 130*b*. It is from this point that the emergent ray 134*b* proceeds to the eye 136*a*, forming an acute angle of approximately 3° with the previously mentioned emergent ray 132*b*.

Considering now the view from the left, which corresponds to FIG. 22, it will be observed that the point 122*b* forms a reflected ray 224*a* which impinges upon the spherical segment 40 of the lens 36 at 228*a*, then emerging as ray 232*a* which strikes the eye 136*b* which is viewing the eyeball unit 32 at the 45° angle which is the same as that involved with respect to FIG. 22.

Similarly, the point 120*b* produces a reflected ray 226*a* which strikes a point at 230*a* on the spherical segment 40 of the lens 36, then passing to the eye 136*b* as indicated by the ray 234*a*.

Thus, it will be recognized that the ray paths 224*a*, 232*a*, 226*a* and 234*a* correspond to the ray paths 124*a*, 132*a*, 126*a* and 134*a*.

Considering now the point 122*a*, it will be noted that there is a reflected ray 224*b* which impinges upon the spherical segment 40 at 228*b*, then proceeding as an emergent ray 232*b* to the eye 136*b*.

There is also a ray 226*b* reflected from the point 120*a* which impinges upon the spherical segment 40 at 230*b*, then proceeding as the emergent ray 234*b* to the eye 136*b*. Here again, the rays 232*b* and 234*b* form an angle of approximately 3° with respect to each other.

It will be observed that the rays 224*b*, 232*b*, 226*b* and 234*b* correspond to the rays 124*b*, 132*b*, 126*b* and 134*b*.

At this time, attention is directed to the points 120*c* and 122*c* on the decal 48. Inasmuch as the eye 136*c* is looking directly at these two points, there is little or no refraction. Hence, the ray 324*a* impinges upon the spherical segment 40 at 328*a* and then proceeds without any noticeable refraction or angle of change as the ray 332*a* to the eye 136*c*. Similarly, the point 122*c* produces a reflected ray 326*a* that impinges upon the spherical segment 40 at 330*a* and then proceeds as the emergent ray labeled 334*a* to the eye 136*c*. The rays 332*a* and 334*a* form a 3° angle relative to each other.

Recapitulating, it will be appreciated that the position of the eye 136*c* in FIG. 24 corresponds to what is to be seen in FIG. 20, whereas the position of the eye 136*a* corresponds to the image appearing in FIG. 21 and the position of the eye 136*b* in FIG. 24 corresponds to what appears in FIG. 22. With the foregoing comparisons in mind, it should be recognized that when an eye, such as the eye labeled 136*a* in FIG. 24, shifts through 45° to the position of the eye 136*c* and then to the position indicated by the eye 136*b*, making a total shift of 90°, the various rays superimposed on FIG. 24 change, as do the pictorial representations between FIG. 21, FIG. 20 and then FIG. 22. What this does is to simulate a movement of the eye, as seen by a viewer looking at an eyeball unit 32. Stated somewhat differently, if the child moves from the position labeled 136*a* to the position labeled 136*b*, such eye positions being designated in FIG. 24, the eye of the eyeball unit 32 seems to follow the child's movement. In other words, the child first sees what is pictured in FIG. 21, then what is pictured in FIG. 20, and then what is shown in FIG. 22. By the same token, should the child move the doll 10 without the child moving, the same simulation of eye movement occurs, for it is only a relative situation as to whether the child moves relative to the doll 10 or the doll 10 is moved relative to the child. The result in either situation is that the eye appears to follow and keep looking at the child irrespective of whether the child is moving or whether the doll 10 is being moved through a corresponding angle. The angle has been rather arbitrarily taken to be 90° comprising the two 45° segments of the movement.

We claim:

1. In an eye assembly for dolls, an eyeball unit including a lens having a rib extending about at least a peripheral portion thereof, a socket unit including a flange having a peripheral portion corresponding in shape to the peripheral portion of said lens, said flange having a groove formed in said peripheral portion thereof, whereby reception of said rib in said groove retains said eyeball unit engaged with said socket unit, said socket unit additionally including a shank, and a holder unit having an aperture therein for receiving a longitudinal portion of said shank, said holder unit being provided with a plurality of resilient fingers adjacent said aperture, each pair of said resilient fingers having a slot therebetween, said shank having a series of longitudinally spaced annular ribs, the free ends of said resilient fingers providing obstructive interference with one of said annular ribs to prevent withdrawal of said shank, and said shank additionally including a longitudinal rib of a width to be received by one of said slots.

2. The combination of claim 1 including an eyelash unit, a portion of said eyelash unit being retained in said groove by said rib.

3. In an eye assembly for dolls, an eyeball unit including a lens having a rib extending about at least a peripheral portion thereof, a socket unit including a flange having a peripheral portion corresponding in shape to the peripheral portion of said lens and having a groove formed therein, said socket unit being comprised of first and second stems, said flange portion being integral with said first stem, and said second stem having a flange portion corresponding in shape to another peripheral portion of said lens and having a groove therein, whereby reception of said rib in said grooves retains said eyeball unit engaged with said socket unit, the portion of said flange integral with said first stem being U-shaped and the portion of said flange integral with said second stem being V-shaped, the end sections of said flange portions abutting each other at predetermined angles.

4. In an eye assembly for dolls comprising a lens having a disc portion and a pair of angularly spaced triangular portions, a rib extending peripherally about said portions, a flange corresponding in shape to said portions, said flange having a groove therein for preventing longitudinal and rotational movement of said lens relative to said flange, a cylindrical shank extending rearwardly from said flange and having an annular rib thereon, a holding member having an aperture therein and a plurality of resilient fingers adjacent said aperture engageable with said annular rib to prevent forward longitudinal movement of said shank relative to said holding member, each pair of said fingers having a slot therebetween, and a longitudinal rib on said shank of a width to be received by one of said slots to prevent the rotation of said shank relative to said holding member.

5. In an eye assembly for dolls, an eyeball unit including a lens having a rib extending about at least a peripheral portion thereof, a socket unit including a flange having a peripheral portion corresponding in shape to the peripheral portion of said lens and having a groove formed therein, said socket unit being comprised of first and second stems, said flange portion being integral with said first stem, and said second stem having a flange portion corresponding in shape to another peripheral portion of said lens and having a groove therein, whereby reception of said rib in said grooves retains said eyeball unit engaged with said socket unit, a shank portion which is integral with said first stem and a shank portion which is integral with said second stem, said shank portions having generally flat mating surfaces, and in which one of said flat surfaces has a longitudinal rib formed thereon and in which the other of said flat surfaces has a longitudinal groove for receiving said longitudinal rib therein.

6. The combination of claim 5 in which said surface having said longitudinal rib thereon also has a notch, and the surface having said longitudinal groove therein has a tab projecting therefrom for reception in said notch.

* * * * *